US005335572A

United States Patent [19]

Kaule

[11] Patent Number: 5,335,572

[45] Date of Patent: Aug. 9, 1994

[54] METHOD AND APPARATUS FOR PROCESSING SHEETS OF MATERIAL IN REGISTER, IN PARTICULAR FOR MAKING SECURITY THREADS

[75] Inventor: Wittich Kaule, Emmering, Fed. Rep. of Germany

[73] Assignee: GAO Gesellschaft fur Automation und Organisation, Fed. Rep. of Germany

[21] Appl. No.: 77,532

[22] Filed: Jun. 17, 1993

Related U.S. Application Data

[62] Division of Ser. No. 472,371, Feb. 1, 1990, Pat. No. 5,239,902.

[30] Foreign Application Priority Data

Feb. 1, 1989 [DE] Fed. Rep. of Germany ..... 3902960

[51] Int. Cl.[5] ..... B65H 23/032

[52] U.S. Cl. ..... 83/74; 83/367; 83/425.2; 83/732; 226/20

[58] Field of Search ..... 83/13, 74, 75.5, 425.2, 83/367, 732, 421; 364/474.09; 144/356; 226/19, 20

[56] References Cited

U.S. PATENT DOCUMENTS

| | | | |
|---|---|---|---|
| 4,093,007 | 6/1978 | Hellstrom | 144/356 |
| 4,633,747 | 1/1987 | Primich | 83/732 |
| 4,694,181 | 9/1987 | Piller | 250/548 |
| 4,819,528 | 4/1989 | Chadwick | 83/13 |
| 4,848,632 | 7/1989 | Mack et al. | 226/20 X |
| 4,892,336 | 1/1990 | Kaule et al. | 283/91 |
| 4,955,265 | 9/1990 | Nakagawa et al. | 83/74 |
| 5,142,955 | 9/1992 | Hale | 83/732 X |

FOREIGN PATENT DOCUMENTS

| | | |
|---|---|---|
| 0110670 | 6/1984 | European Pat. Off. . |
| 0238043 | 9/1987 | European Pat. Off. . |
| 1446851 | 11/1968 | Fed. Rep. of Germany . |
| 2146492 | 3/1973 | Fed. Rep. of Germany . |
| 1095286 | 12/1967 | United Kingdom . |

*Primary Examiner*—Richard K. Seidel
*Assistant Examiner*—Kenneth E. Peterson
*Attorney, Agent, or Firm*—Robert J. Koch

[57] ABSTRACT

The invention relates to a method, an apparatus and sheets of materials for producing marked security threads as are used to increase the protection of documents and papers of value against forgery. The inventive method is for processing, in particular cutting, security threads out of sheets of material in register, the sheets of material being fed to the processing units in exact alignment. The feed principal is based on guiding the sheet of material on at least one edge of the sheet, determining the position relative to one of the edges of the sheet, producing a signal from the determination of position, and positioning the feeding device relative to the processing unit so that the sheet of material runs into the latter in a predetermined position.

8 Claims, 3 Drawing Sheets

METHOD AND APPARATUS FOR PROCESSING SHEETS OF MATERIAL IN REGISTER, IN PARTICULAR FOR MAKING SECURITY THREADS

This is a division of application Ser. No. 07/472,371, filed Feb. 1, 1990 now U.S. Pat. No. 5,239,902.

BACKGROUND OF THE INVENTION

1. Field of the Invention

The present invention relates to a method for processing sheets of material in register, in particular for making security elements, according to the preamble of claim 1, to an apparatus for carrying out this method, and to sheets of material that can be used as a semifinished product for making security threads.

2. Description of the Related Technology

In order to protect bank notes, papers of value, identity cards, etc., better against forgery, it is known to equip these documents with security threads, in addition to other security features. In the case of paper products the security threads are introduced into the furnish layer as it is forming during paper production, while in the case of multilayer plastic products they are embedded between two or more individual layers.

The security threads are provided with, among other things, printing extending in the longitudinal direction of the thread, whereby such known printing may be present in the form of patterns or alphanumeric characters, optically effective structures and/or readily visual and/or only machine readable prints, additives or coatings. The printing extends in a constant form over the entire length of the thread, whereby a pattern or writing is repeated any number of times. In the following text, a term such as "printed pattern." "printing." etc., stands for any kind of marking: it also includes embossings, punchings, coatings etc.

For reasons of manufacturing technology, printed security threads are produced from wide sheets of film. The sheets of film are first printed with patterns or writing in a parallel arrangement: these sheets of film are then cut into the individual security threads. Since the threads generally have a width of only 0.5–1.5 mm, great effort is usually required to cut the film in register with the printing. One has therefore in many cases preferred to select the individual lines of writing and the width of the threads in such a way that at least one line of writing is always found completely on the thread after it is cut (DE-OS 14 46 851).

Another known method consists in printing the desired pattern on transparent films with large spaces between the prints and then performing the cut in the spaces. After the security thread is embedded in the paper the transparent area is not recognizable: one can only see the printed pattern running in the longitudinal direction of the thread. This method involves the consequence that the thread to be embedded must be considerably wider than the visible thread portion. The embedding of a wide thread has an adverse effect on the quality of the document and security paper, reducing the tearing strength of the paper and the adherence of the thread in the paper. Furthermore, threads exceeding a certain width can no longer be embedded in the paper with the necessary reliability of manufacture, i.e. without forming holes.

A method that avoids the above problems and allows sheets of film to be processed in register is known, for example, from EP-A 0 238 043. In this known method, security threads, or the sheets of film bearing the security threads, are equipped with a mechanically detectable longitudinal surface structure. Using profiled rollers or similar devices which engage these structures, one can thus feed the sheets of film to further processing devices, such as printing devices or cutting devices, in exact alignment with these structures. However, this solution can only be used for sheets of film having a suitable surface structure, or requires an additional method step to apply the surface structure.

Other methods known from general printing technology are to guide sheets of material by means of printed markings. When the sheets of material run into the processing unit, e.g. a cutting unit, the positional deviations of the markings from desired positions are picked up by sensors. A control signal formed therefrom is fed to a register control means which then performs a correction of position (DE-AS 21 46 492). However, this marking-controlled positioning of the sheet involves substantial disadvantages.

Thus, it is necessary to dispose the sensor as close as possible to the actual place of processing in order to avoid sources of error, in particular to prevent the sheets of material from running out between the sensor and the cutting position. Furthermore, the sensor and the processing units must be in a fixed spatial relation to each other, which necessitates an additional stable mechanical connection between the machine and the sensor.

These requirements—a fixed structure and adjacent positioning of the sensor to the processing—lead to many kinds of problems. In many cases the available space does not allow the sensor to be disposed in the immediate vicinity of the place of processing. When this is in fact possible, it causes problems for servicing and adjustment work since the sensors are poorly accessible. Furthermore, the immediate vicinity of the sensitive sensors to the processing device increases the danger of their being soiled and damaged. Also, the required space makes it difficult to retrofit existing cutting machines with a sheet positioning means.

A further serious disadvantage is that the task of precisely supplying the sheet of material can often be fulfilled with sufficient reliability by the known methods only under special operating conditions.

A known arrangement for controlling deviations from a desired position comprises a feeding device (register control means, etc.) and a sensor head which are passed in this order by a sheet of material provided with control markings (DE-AS 21 46 692). The cutting unit is located optionally before or behind the sensor head. The sensor head continuously detects the deviations of the sheet markings from a desired position, forms a control signal and passes it to the feeding device. The feeding device uses the control signal to correct the position of the sheet of material relative to the cutting unit. The disadvantage of this arrangement is that one obtains different control characteristics depending on the momentarily existing parameters of the arrangement (control speed, sensor sensitivity, sheet speed, etc.). If the system damping is too low or, equivalently, if the register control means overreacts, the deviation control means passes into a permanently oscillating state. If the system damping is too high, the time constant of the deviation control is not large enough so that errors are corrected too late. This control means requires precisely fixed parameters and works in the desired manner only within a narrow parameter range. However, the narrower the tolerance limits, the more effort is required for regulation, production methods and production control. At warrantable effort, the attainable cutting tolerances are several tenths of a millimeter.

In the interests of high protection against forgery and reliable embedding in the paper, it is desirable to have narrow, e.g. millimeter-wide, security threads with predefined placement of the marking with respect to the geometry of the thread. The necessary thread dimensions result in a maximum cutting tolerance of 0.1 millimeters. One must take account of the fact that the paper is produced in long sheets and the security threads must accordingly also be made available in long threads. This means that the processing method must guarantee that narrow tolerance limits are met over a long cutting length.

If security threads are cut with a width in the submillimeter range using the known control techniques which correct deviations from the desired position in extremely different ways depending on the existing method parameters, great control effort is required for meeting the tolerances. Large deviations cannot be permitted for the above reasons.

The known control techniques are thus inapplicable, or insufficiently applicable, for making security threads with a printed pattern located exactly over the width of the thread.

SUMMARY OF THE INVENTION

The present invention is based on the problem of providing a method and an apparatus for making security threads having printing extending in the longitudinal direction, whereby this marking must be exactly aligned with the geometry of the thread while narrow tolerances and high quality are met. Furthermore, spatially flexible possibilities of design should make the apparatus resulting from this method easy to integrate into existing processing or manufacturing devices.

This problem is solved by the features contained in the characterizing part of claim 1. An apparatus for producing and processing security threads is the object of an independent claim. A sheet of material as can be used as a semifinished product for making and processing security threads is also the object of an independent claim.

The particular advantage of the invention is that a method is used that allows for position control in the technical sense. That is, in accordance with a determined position of the printing relative to the edge of the sheet the feeding device is given a control signal, the common reference line being the edge of the sheet. Such position control means are free from regulating errors, unlike position regulators which can only react to deviations from desired values.

A further advantage of the inventive method is that one is very free in selecting the location of the sensors. The sensor can thus be disposed at basically any distance from the processing unit. It must merely be ensured that when every point on the sheet of film runs into the unit the corresponding control signal is applied to the feeding device. A constant belt speed, or an exact machine pace, facilitates this task.

This method makes it possible to cut sheets of film on which the security thread printing is disposed many times side by side, in such a way that each thread cut out of this sheet has its printing in the desired position, e.g. in the center.

In a preferred embodiment of the invention, the cutting process is performed in two steps. The two steps of the cutting process are a rough cut and a fine cut. In the first step, the rough cut, several strips of equal width are cut out of the meter-wide sheets of film. Due to their constant width these strips of film can be directed reliably by the edges in standardized devices of simple design. In the second step, the fine cut, the individual security threads are then cut out of the strips of film.

The usually transparent films are preferably designed in such a way that a number of copies (the printing of individual security threads) is followed by an area with no such printing. This area is printed with a control line contrasting with the transparent sheet of film. In the rough cut the sheet of film is cut into strips along this control line, the latter being of a width such that the cutting line always extends within this control line. Since the control line is printed on together with the printing, there is a guarantee that the edges of the control lines extend parallel to the printing.

After the rough cut of the sheet of film one thus obtains strips of film having an interrupted control line on at least one edge of the sheet. Since the edge of the printing and the edge of the control line are parallel, the width of this cut control line is a direct measure of the distance between the printing and the edge of the sheet. To perform the fine cut by the inventive method, it is thus merely necessary to determine the remaining width of the control line. The resulting measured value can then be used directly to form the control signal for the feeding device. To determine the measured signal one preferably uses optical sensors, for example a lattice of CCD sensors.

The inventive method can be used not only for cutting devices, but also in other processes and ways of treating sheets of material, e.g. for applying embossed structures in exact alignment with printing previously applied to a film, for applying printing to be exactly associated with markings already present on the sheet of material, etc.

Further advantages, advantageous embodiments and developments are the object of the subclaims and the description with reference to the figures.

DETAILED DESCRIPTION OF THE PREFERRED EMBODIMENT

Figure 1:
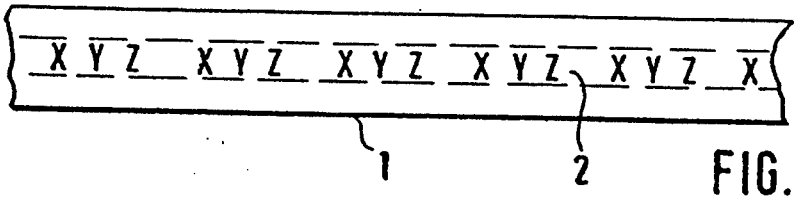
FIG. 1 shows a security thread.

FIG. 1 shows a security thread 1 which is better protected against forgery by being provided with printing 2 aligned with the middle of the thread. In the example shown, the printing consists of the letters "XYZ", which are repeated along the length of the thread. The material used for security threads is preferably transparent plastic such as polyester. The width of the threads which are embedded in paper typically ranges from 0.5 to 1.5 mm; threads embedded in plastic may also be wider.

Figure 2:
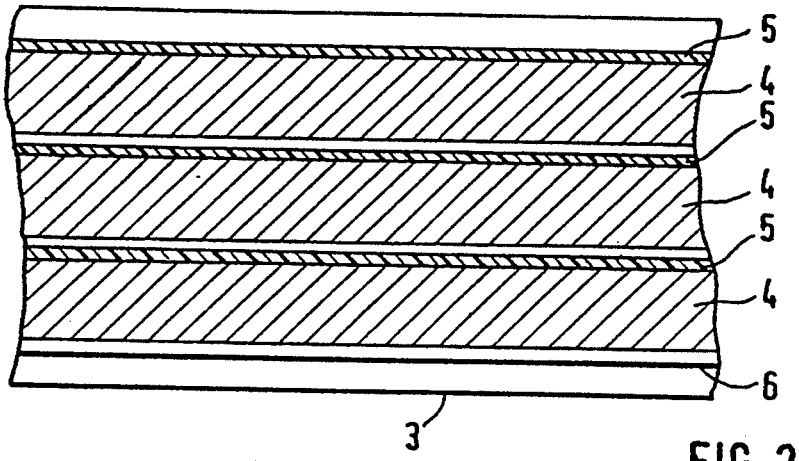
FIG. 2 shows a printed sheet of film as is used as a semifinished product for security threads.

The security threads are produced from sheets of film having a useful width of 0.5 to 1.5 m. FIG. 2 shows an embodiment of a sheet of film 3 as is used as a semifinished product for making security threads. The printing on the sheet of film consists of packages of copies 4 disposed side by side with control lines 5 adjacent thereto or located therebetween. The packages of copies themselves consist of individual copies one beside the other, the number of copies in such a package being approximately fifty, and each containing the printing for a security thread. The control lines are located in the unprinted area between the packages of copies and extend parallel thereto.

In a first cutting operation, the rough cut, sheet of film 3 is cut into individual strips of film each containing a package of copies. The sheet feed is adjusted on the basis of control lines 5 or separate edge lines 6.

In the preferred embodiment shown here, the film is cut by a plurality of parallel cutting knives, the cutting knives being disposed in such a way that the cut is performed within these control lines 5.

Figure 3:
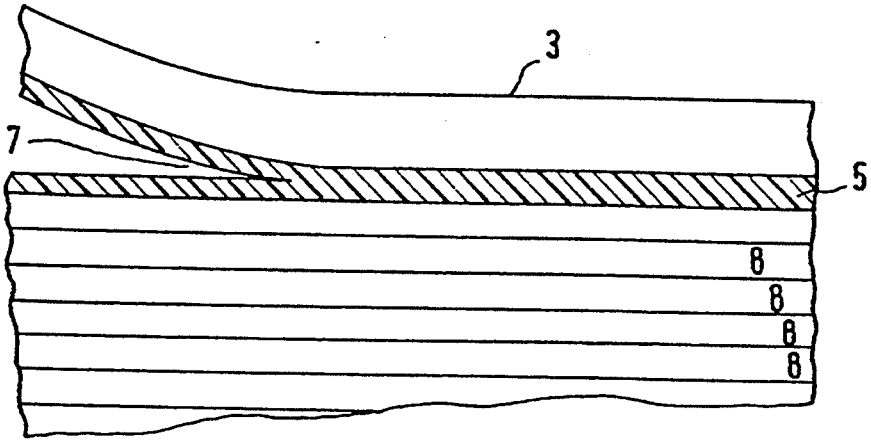
FIG. 3 shows a section of the sheet of film of FIG. 2.

FIG. 3 shows a section of such a sheet of film 3, with rough cutting line 7 extending within control line 5. Control line 5 is directly adjacent to printing 8 of the individual security threads.

The width of the control lines is selected so as to ensure that the rough cutting line extends within the control line along the entire length of the sheet, even when all cutting tolerances are met. Due to the parallel arrangement of the knives, the sheets of film are also cut constantly in a predetermined width along the entire length of the sheet.

Figure 4:
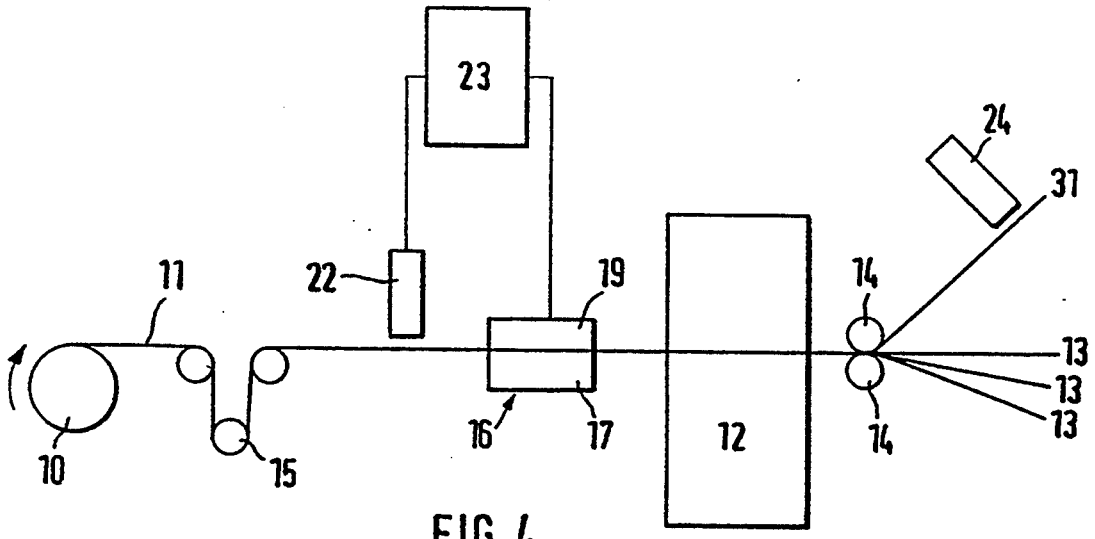
FIG. 4 shows an inventive apparatus for cutting strips of film in a side view.
Figure 5:
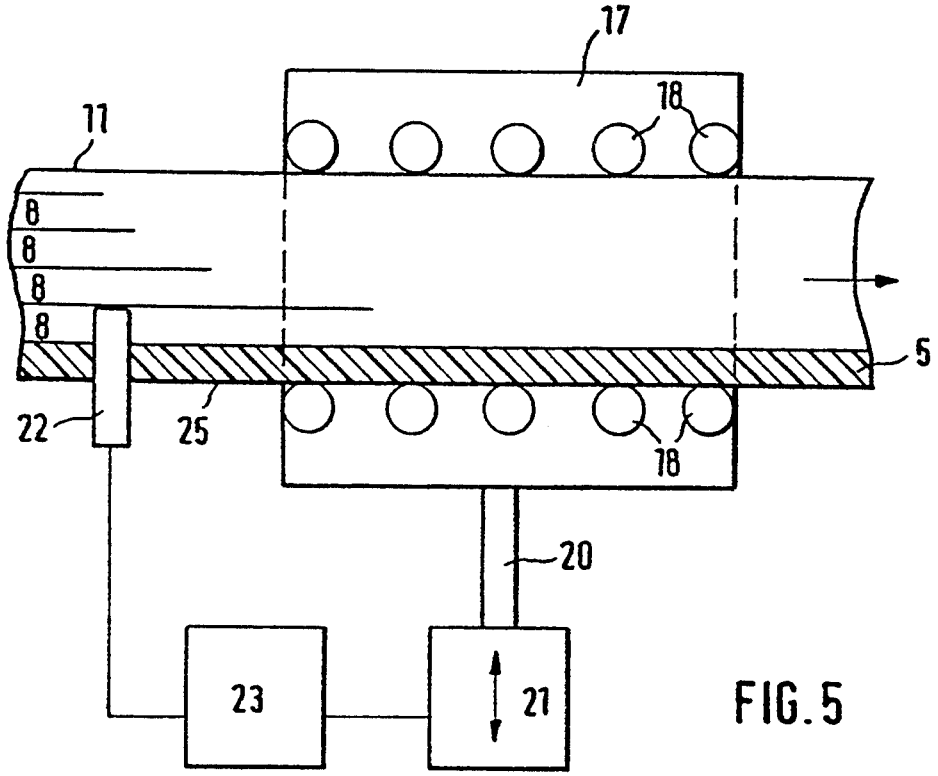
FIG. 5 shows a feeding device with a measurement control circuit for feeding strips of film.

These strips of film are cut into the individual security threads in a fine cutting operation in an apparatus shown schematically in FIGS. 4 and 5. The strips of film wound onto temporary storage rollers 10 during the rough cut are removed from these storage rolls in this apparatus and fed with the aid of a transport device to the processing unit, in this case a cutting unit 12. This cutting unit 12 is equipped with a cutter block not shown in the figures, which consists of a plurality of disklike knives disposed on a common axle. The number of knives is coordinated with the number of individual copies on the strip of film; the distance depends on the desired width of the security thread. When the strip of film runs through this cutting means 12 this film is thus cut into a number of security threads 13 which, after they have passed rollers 14, are separated from each other and wound onto individual spools, which are also not shown. The transport system comprises a compensating unit 15 for keeping the strip speed constant at the predetermined value.

The cutting means is preceded by a feeding device 16 for introducing strip 11 into cutting means 12, in particular the cutter block, in a predetermined position relative thereto. In a simple case, this feeding device consists of a base plate 17 with two rows of guide pins 18 parallel to the running direction of the strip; the distance between the rows is coordinated with the strip width so that the strip is guided by edge contact on both sides. The feeding device is covered by an upper cover 19.

Spacing members which are somewhat higher then the strip thickness and located between base plate 17 and cover 19 ensure an unobstructed run of the strip through the feeding device. The device is altogether displaceable laterally to the running direction of the strip, e.g. via a spindle drive 20. The displacement is controlled via an actuator 21, for example a step motor. This lateral displacement of the feeding device allows the strip to be introduced into the subsequent processing means in a predetermined geometrical association therewith.

The particular position of feeding device 16 is determined via a measuring and control circuit. For this purpose the feeding device is preceded by a measuring means 22 which is disposed in the area of cut control line 5 and used for measuring the width of this control line. The measuring means used may be e.g. a CCD element in conjunction with corresponding electronic circuits 23 which produce a control signal for positioning on the basis of the measurement result.

The width of this cut control line 5 is a direct measure of the distance between the printing of the individual security threads and edge 25 of the strip. If one measures the width of this control line one can thus calculate precisely in advance the position in which the strip of film must be held with the aid of the feeding device when it runs into the processing device, so that the printing of the individual security threads runs in exactly between two knives e.g. in the desired central position.

Measuring means 22 itself may be disposed at virtually any distance from the processing or feeding unit. One must merely ensure, e.g. via a corresponding time correlation, that the control signal determined from the width of the control line detected for a certain strip portion is applied to the feeding device at the moment when the strip portion in question is running through the feeding device. To avoid errors here, one uses additional elements, such as counting means for strip lengths, for controlling and registering the strip run. The time correlation may also be provided by utilizing the machine pace or a constant band speed of the transport means.

The feeding device shown here may also be replaced by similar devices which guide the strip e.g. only on one edge and ensure by corresponding mechanical means that the strip always lies with its leading edge against the feeding device. Furthermore, the reel-cutting machine with cutting rollers in mutually fixed arrangement may be replaced by other processing units, such as embossing machines, printing devices and the like, for applying any patterns along each security thread in exact alignment with the printed pattern. These devices may additionally be followed by the above-described cutting means. The supply of the strip to the processing units and to the cutting unit may be controlled via a single feeding device, as described above, whereby this feeding device precedes both units. However, each of the processing units may also be provided with such a feeding device, whereby both feeding devices and the corresponding actuators may make use of the measuring result of a common measuring means.

According to an advantageous development, the inventive apparatus is extended by a further measuring unit 24 permitting a final check. This control means 24 may be e.g. a CCD camera which detects one of the already cut threads and can be used to check the actual position of the printing on the thread substitutionally for all the others. This means can be used to detect e.g. systematic errors which may arise through zero maladjustment of the feeding device relative to the processing means. Such errors cannot be detected by above-described measuring means 22.

Figure 6:
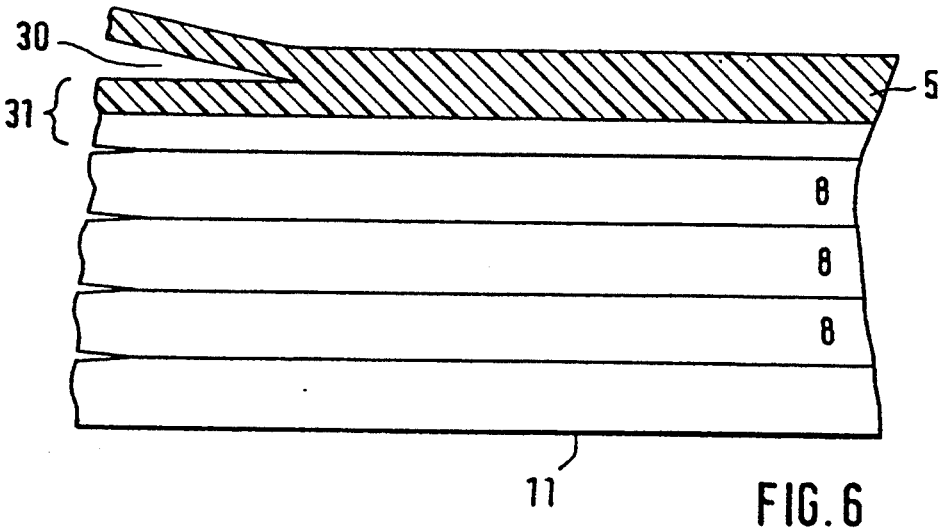
FIG. 6 shows a strip of film with the position of the cutting lines.

In order to create a good precondition for optical sensing for the control means as well, one preferably also performs the fine cut in such a way that at least one of the cutting lines extends within the control line (FIG. 6). When thread 31 containing this part of the control line is run into control means 24, one can easily detect, with high contrast, the width of the control lines remaining on the thread. If the strip of film was supplied to the processing or cutting means in the correct position, this control line on control thread 31 has a predetermined width, since the control line was printed on the film together with the printing of the individual security threads and this common print ensures that the control line is located at a predetermined distance from this printing. The control means, which may be of similar construction to the measuring means but is disposed behind the processing unit, allows for continuous quality control that can be performed with simple measuring technology.

Figure 7:
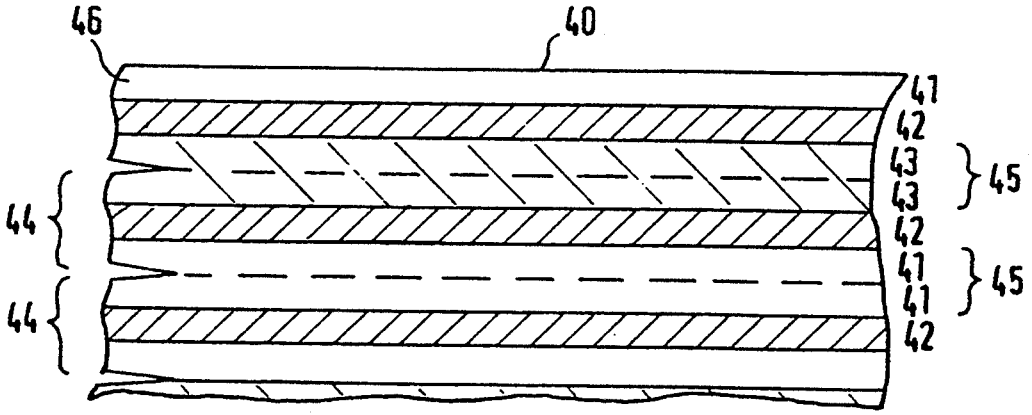
FIG. 7 shows a further embodiment of a strip of film.

In the examples described above, it was always assumed that the feed of the strip of film into the processing means is controlled on the basis of specially provided control lines. However, in many cases the printing of the individual security threads already meets the requirements in terms of design and contrast to be able to serve as a control line itself. In the case of security threads having e.g. a pattern of longitudinal stripes, one of the colored stripes can be used directly as a control line. FIG. 7 shows such an embodiment. The security thread is to bear a pattern with three different-colored parallel stripes, e.g. in the national colors black, red and gold. For this purpose, colored stripes 41, 42, 43 are printed on a corresponding film side by side, without spaces therebetween and with the sequence of colors changing from thread to thread. This arrangement leads to colored stripes 45 with double width at regular intervals. If the film is printed over its entire width with these striped patterns in close succession, the rough cut in the first cutting operation can be performed in each one of these double colored stripes 45, and the remaining stripe width 46 from strip of film 40 can be used by the above-described method for adjusting the strip of film for the fine cutting unit. In the fine cutting unit a knife then runs into each of these double colored stripes, so that one obtains security threads having three longitudinal colored stripes of identical dimensions.

This arrangement of the colored stripes also has the advantage that one need not cut exactly between two directly adjacent colored stripes. In this case, tiny deviations would cause the security thread to have undesirable colored edges which are generally quite visible. The above-described colored stripe arrangement makes it possible to print the sheets of film with the various colored stripes directly adjacent to each other without any spaces being necessary therebetween to compensate cutting tolerances.

I claim:

1. A sheet processing apparatus comprising:

a transport means for feeding a sheet of material to a processing unit;

feeding means, disposed before the processing unit, for feeding the sheet of material and guiding it on at least one edge to the processing unit in a predetermined position relative thereto;

a measuring means, disposed before the feeding device, for determining the position of a marking on said sheet relative to an edge of said material;

a control unit responsive to said measuring means; and an actuator means for positioning the feeding device responsive to said control unit.

2. The apparatus of claim 1 wherein said processing unit is a reel-cutting machine with cutting rollers in mutually fixed arrangement.

3. The apparatus of claim 2 further comprising a cutting machine provided before said processing machine for cutting the sheet of film into a constant width adapted to the feeding device.

4. The apparatus of claim 3 wherein said measuring means is an optical sensor.

5. The apparatus of claim 4 further comprising a displaceable table with step motor control carrying said feeding means.

6. The apparatus of claim 2 wherein the processing unit is followed by a second control unit which is fed at least one thread for testing marking position.

7. The apparatus of claim 2, wherein said measuring means is an optical sensor.

8. The apparatus of claim 1, wherein said measuring means is an optical sensor.

* * * * *